US010179423B2

(12) United States Patent
Monbetsu et al.

(10) Patent No.: US 10,179,423 B2
(45) Date of Patent: Jan. 15, 2019

(54) SHEET MANUFACTURING APPARATUS

(71) Applicant: SEIKO EPSON CORPORATION, Tokyo (JP)

(72) Inventors: Yoshinobu Monbetsu, Matsumoto (JP); Seiichi Taniguchi, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 553 days.

(21) Appl. No.: 15/000,235

(22) Filed: Jan. 19, 2016

(65) Prior Publication Data

US 2016/0221214 A1 Aug. 4, 2016

(30) Foreign Application Priority Data

Jan. 29, 2015 (JP) ..... 2015-015221

(51) Int. Cl.

| | |
|---|---|
| ***B27N 3/04*** | (2006.01) |
| ***B27N 3/14*** | (2006.01) |
| ***D21B 1/08*** | (2006.01) |
| ***D21C 5/02*** | (2006.01) |
| *D21D 5/02* | (2006.01) |
| *D21D 5/24* | (2006.01) |
| *D21F 9/02* | (2006.01) |
| *D21B 1/32* | (2006.01) |
| *B27N 1/02* | (2006.01) |

(52) U.S. Cl.

CPC ..... *B27N 3/04* (2013.01); *B27N 3/14* (2013.01); *D21B 1/08* (2013.01); *D21C 5/02* (2013.01); *B27N 1/02* (2013.01); *D21B 1/32* (2013.01); *D21D 5/02* (2013.01); *D21D 5/24* (2013.01); *D21F 9/02* (2013.01)

(58) Field of Classification Search

CPC ... B27N 1/02; B27N 3/04; B27N 3/14; D21B 1/08; D21B 1/10; D21B 1/32; D21C 5/02; D21D 5/02; D21D 5/24; D21F 9/02

See application file for complete search history.

(56) References Cited

U.S. PATENT DOCUMENTS

| | | | | |
|---|---|---|---|---|
| 8,882,965 | B2 | 11/2014 | Yamagami et al. | |
| 9,194,081 | B2 | 11/2015 | Yamagami | |
| 2004/0043096 | A1* | 3/2004 | Graf | B27N 3/04 425/371 |
| 2007/0229875 | A1 | 10/2007 | Suzuki | |
| 2013/0292228 | A1* | 11/2013 | Webb | B65G 47/19 198/459.5 |
| 2014/0027075 | A1* | 1/2014 | Yamagami | D21B 1/08 162/4 |

(Continued)

FOREIGN PATENT DOCUMENTS

| | | |
|---|---|---|
| JP | 2007-293819 A | 11/2007 |
| JP | 2011-122253 A | 6/2011 |

(Continued)

*Primary Examiner* — Yogendra N Gupta
*Assistant Examiner* — Joseph S Leyson
(74) *Attorney, Agent, or Firm* — Workman Nydegger

(57) ABSTRACT

A sheet manufacturing apparatus includes a raw material detection unit that detects a raw material amount stacked on a stacking unit, a calculation unit that calculates a first amount of the sheet able to be manufactured in the sheet manufacturing apparatus based on a detection result of the raw material detection unit, and an output unit that outputs the sheet amount calculated by the calculation unit.

5 Claims, 5 Drawing Sheets

(56) References Cited

U.S. PATENT DOCUMENTS

| | | | | |
|---|---|---|---|---|
| 2014/0290887 | A1 | 10/2014 | Gomi et al. | |
| 2015/0184341 | A1* | 7/2015 | Tanaka | D21F 7/00 162/252 |

FOREIGN PATENT DOCUMENTS

| | | | |
|---|---|---|---|
| JP | 2012-144819 | | 8/2012 |
| JP | 2014-208924 | A | 11/2014 |

* cited by examiner

SHEET MANUFACTURING APPARATUS

BACKGROUND

1. Technical Field

The present invention relates to a sheet manufacturing apparatus and a sheet manufacturing method.

2. Related Art

In the related art, a paper recycling apparatus for recycling a raw material such as used paper into recycled paper has been known (for example, JP-A-2012-144819).

In the paper recycling apparatus of the related art, the manufacturable number of sheets cannot be grasped before the start of manufacturing the recycled paper.

SUMMARY

The invention can be realized in the following aspects or application examples.

(1) According to an aspect of the invention, there is provided a sheet manufacturing apparatus for manufacturing a sheet by using a raw material containing fibers supplied from a stacking unit on which the raw material is stacked, the apparatus including a raw material detection unit configured to detect a raw material amount stacked on the stacking unit; a calculation unit configured to calculate a first amount of the sheet able to be manufactured in the sheet manufacturing apparatus based on a detection result of the raw material detection unit; and an output unit configured to output the sheet amount calculated by the calculation unit.

Here, the "raw material amount" includes the number of cut sheets, a weight of cut sheets that are the raw material, and a weight of the raw material that is crushed. Furthermore, the "sheet amount" includes the number of the cut sheets and a length of a continuous sheet. Furthermore, "outputting" includes a case of outputting to a display unit (display) and a case of transmitting to an external apparatus through a network.

In this case, the raw material amount stacked on the stacking unit is detected, the sheet amount able to be manufactured is calculated based on the detection result, and the calculated sheet amount is output. Thus, a user can grasp in advance the sheet amount able to be manufactured from the raw material stacked on the stacking unit.

(2) According to another aspect of the invention, there is provided a sheet manufacturing apparatus for manufacturing a sheet by using a raw material containing fibers supplied by a supply unit supplying the raw material, the apparatus including an adding unit configured to add additives to the raw material supplied by the supply unit; a remaining amount detection unit configured to detect an additive remaining amount; a calculation unit configured to calculate the sheet amount able to be manufactured in the sheet manufacturing apparatus based on a detection result of the remaining amount detection unit; and an output unit configured to output the sheet amount calculated by the calculation unit.

In this case, the additive remaining amount is detected, the sheet amount able to be manufactured is calculated based on a detection result, and the calculated sheet amount is output. Thus, the user can grasp in advance the sheet amount able to be manufactured from the additive remaining amount.

(3) According to still another aspect of the invention, there is provided a sheet manufacturing apparatus for manufacturing a sheet by using a raw material containing fibers supplied by a supply unit supplying the raw material, the apparatus including a storage unit configured to store at least a part of the raw material supplied by the supply unit which is not used in manufacturing of the sheet; a storage amount detection unit configured to detect an amount able to be stored in the storage unit; a calculation unit configured to calculate the sheet amount able to be manufactured in the sheet manufacturing apparatus based on a detection result of the storage amount detection unit; and an output unit configured to output the sheet amount calculated by the calculation unit.

In this case, the amount able to be stored in the storage unit is detected, the sheet amount able to be manufactured is calculated based on a detection result, and the calculated sheet amount is output. Thus, the user can grasp in advance the sheet amount able to be manufactured from the amount of a removal material such as a color material which can be stored in the storage unit.

(4) The sheet manufacturing apparatus may further include an adding unit configured to add additives to the raw material supplied from the stacking unit, and a remaining amount detection unit configured to detect an additive remaining amount, in which the calculation unit may calculate a second amount of the sheet able to be manufactured in the sheet manufacturing apparatus based on a detection result of the remaining amount detection unit, and the output unit may output the smaller one of the first amount and the second amount.

In this case, the user can grasp in advance the sheet amount (the sheet amount able to be manufactured without replenishing the raw material and the additives during manufacturing) able to be manufactured from the raw material stacked on the stacking unit and the additive remaining amount.

(5) The sheet manufacturing apparatus may further include a storage unit configured to store at least a part of the raw material supplied from the stacking unit which is not used in manufacturing of the sheet, and a storage amount detection unit configured to detect an amount able to be stored in the storage unit, in which the calculation unit may calculate a third amount of the sheet able to be manufactured in the sheet manufacturing apparatus based on a detection result of the storage amount detection unit, and the output unit may output the smallest one of the first amount, the second amount, and the third amount.

In this case, the user can grasp in advance the sheet amount (sheet amount able to be manufactured without replenishing the raw material and the additives during manufacturing and without removing the removal material stored in the storage unit) able to be manufactured from the raw material stacked on the stacking unit, the additive remaining amount, and the amount able to be stored in the storage unit.

(6) According to still another aspect of the invention, there is provided a sheet manufacturing method for manufacturing a sheet by using a raw material containing fibers supplied from a stacking unit on which the raw material is stacked, the method including detecting a raw material amount stacked on the stacking unit; calculating a first amount of the sheet able to be manufactured in the sheet manufacturing apparatus based on a detection result of the raw material; and outputting the sheet amount calculated by the calculating.

In this case, the raw material amount stacked on the stacking unit is detected, the sheet amount able to be manufactured is calculated based on the detection result, and the calculated sheet amount is output. Thus, the user can grasp in advance the sheet amount able to be manufactured from the raw material stacked on the stacking unit.

(7) According to still another aspect of the invention, there is provided a sheet manufacturing method for manufacturing a sheet by using a raw material containing fibers supplied by a supply unit supplying the raw material, the method including adding additives to the raw material supplied by the supply unit; detecting an additive remaining amount; calculating the sheet amount able to be manufactured in the sheet manufacturing apparatus based on a detection result of the remaining amount; and outputting the sheet amount calculated by the calculating.

In this case, the additive remaining amount is detected, the sheet amount able to be manufactured is calculated based on the detection result, and the calculated sheet amount is output. Thus, the user can grasp in advance the sheet amount able to be manufactured from the additive remaining amount.

(8) According to still another aspect of the invention, there is provided a sheet manufacturing method for manufacturing a sheet by using a raw material containing fibers supplied by a supply unit supplying the raw material, the method including storing at least a part of the raw material supplied by the supply unit which is not used in manufacturing of the sheet; detecting an amount able to be stored in the storage unit; calculating the sheet amount able to be manufactured in the sheet manufacturing apparatus based on a detection result of the storage amount; and outputting the sheet amount calculated by the calculating.

In this case, the amount able to be stored in the storage unit is detected, the sheet amount able to be manufactured is calculated based on the detection result, and the calculated sheet amount is output. Thus, the user can grasp in advance the sheet amount able to be manufactured from the amount of a removal material such as a color material which can be stored in the storage unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described in detail with reference to the drawings. Moreover, the embodiments described below do not unduly limit contents of the invention described in the claims. In addition, not all of the elements that are described are essential requirements of the invention.

1. Configuration

Figure 1:
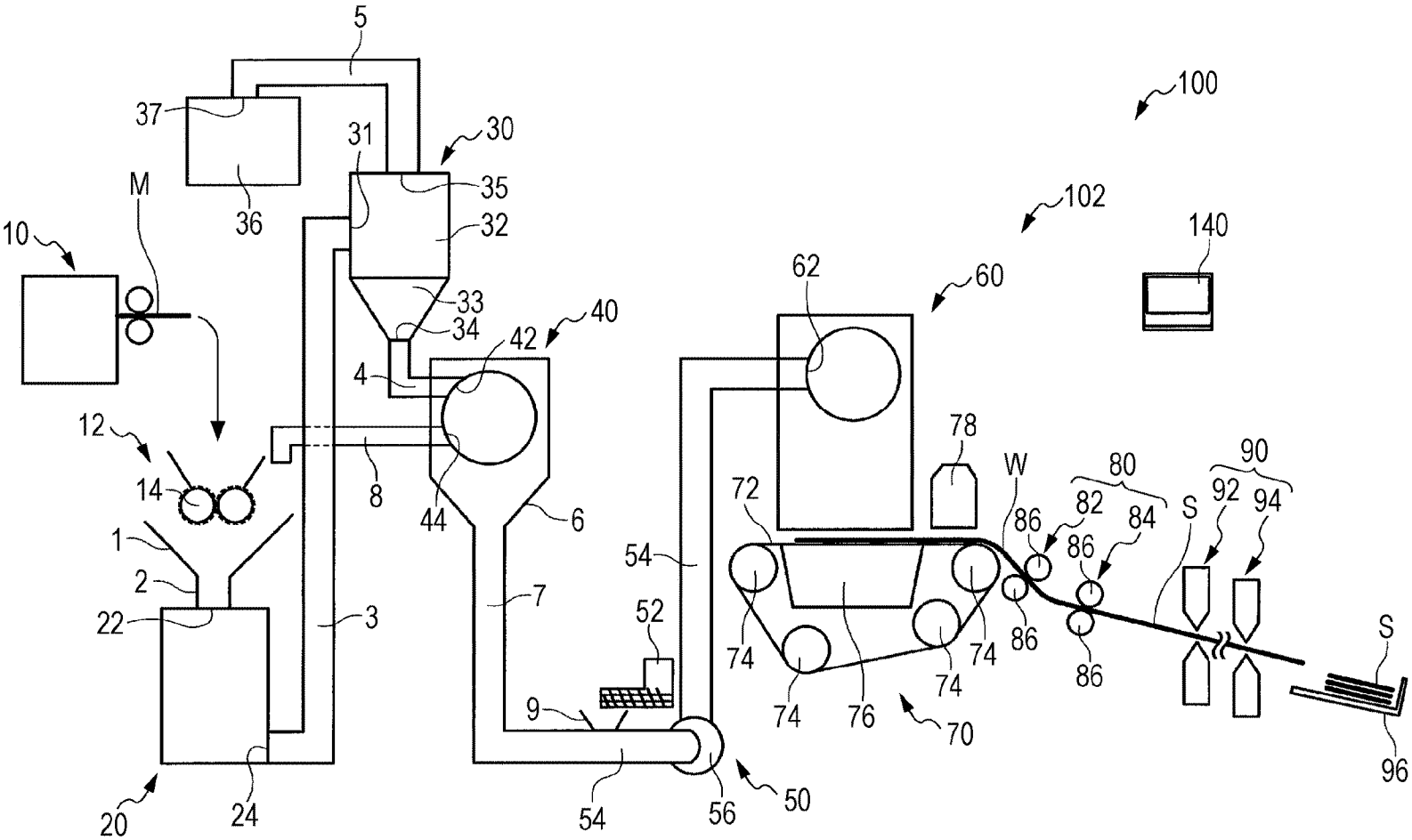
FIG. 1 is a view schematically illustrating a sheet manufacturing apparatus according to an embodiment.

First, a sheet manufacturing apparatus according to the embodiment will be described with reference to the drawings. FIG. 1 is a view schematically illustrating a sheet manufacturing apparatus 100 according to the embodiment.

As illustrated in FIG. 1, the sheet manufacturing apparatus 100 includes a supply unit 10, a manufacturing unit 102, and a control unit 140. The manufacturing unit 102 manufactures a sheet. The manufacturing unit 102 has a crushing unit 12, a defibrating unit 20, a classifying unit 30, a sorting unit 40, a mixing unit 50, an accumulation unit 60, a web formation unit 70, a sheet formation unit 80, and a cutting unit 90. In this specification, the mixing unit 50, the accumulation unit 60, and the web formation unit 70 may also be referred to as a forming unit.

The supply unit 10 (stacking unit) supplies a material M to the crushing unit 12. The supply unit 10 is, for example, an automatic feeding unit for continuously feeding the material M into the crushing unit 12. The material M supplied by the supply unit 10 is a cut sheet material containing fibers and is, for example, used paper, pulp sheet, and the like. The supply unit 10 stores (stacks) a plurality of cut sheet materials and includes a delivery mechanism for delivering the stored materials to the outside one by one. Furthermore, the supply unit 10 includes a raw material detection unit (not illustrated) detecting a stacked raw material amount.

The crushing unit 12 cuts (coarsely grinds) the raw material M supplied by the supply unit 10 to be shredded pieces in the air. Shapes and sizes of the shredded pieces are, for example, several cm squares. In the illustrated example, the crushing unit 12 has crushing blades 14 and the fed raw material M can be cut by the crushing blades 14. For example, as the crushing unit 12, a shredder is used. The raw material that is cut by the crushing unit 12 is received by a hopper 1 and then is transferred (transported) to the defibrating unit 20 through a pipe 2.

The defibrating unit 20 defibrates the raw material that is cut by the crushing unit 12. Here, "defibrating" means that the raw material (object to be defibrated) formed by binding a plurality of fibers is untangled into untangled fibers one by one. The defibrating unit 20 also has a function of separating a material such as resin particles, ink, toner, and a blur-preventing agent, attached to the raw material from the fibers.

A material passing through the defibrating unit 20 is referred to as "defibrated material". In addition to the untangled defibrated material fibers, the "defibrated material" may contain the resin (resin for binding a plurality of fibers to each other) particles, a coloring material such as ink and toner, the blur-preventing agent, and additives such as a paper strengthening agent separated from the fibers when untangling the fibers. A shape of the untangled defibrated material is a string shape or a ribbon shape. The untangled defibrated material may be present in a state of not being intertwined with other untangled fibers (independent state) or may be present in a state of being a lump shape by being intertwined with other untangled defibrated materials (so-called a state of forming "lumps").

The defibrating unit 20 performs dry type defibration in the atmosphere (in air). Specifically, as the defibrating unit 20, an impeller mill is used. The defibrating unit 20 has a function of sucking the raw material and generating airflow so as to discharge the defibrated material. Thus, the defibrating unit 20 sucks the raw material from an inlet 22 together with airflow by the airflow generated by the defibrating unit 20, performs a defibrating process, and then the defibrated material can be transported to an outlet 24. The defibrated material passing through the defibrating unit 20 is transmitted to the classifying unit 30 through a pipe 3.

The classifying unit 30 classifies the defibrated material passing through the defibrating unit 20. Specifically, the classifying unit 30 classifies and removes matter (resin particles, color material, additives, and the like) that is relatively small in size and has low density in the defibrated material. Thus, it is possible to increase a ratio of fibers that are relatively large in size and have high density in the defibrated material.

As the classifying unit 30, an airflow type classifier is used. The airflow type classifier generates a whirling airflow and separates the defibrated material by a difference in centrifugal force received by the size and density of the defibrated material that is separated. Thus, it is possible to adjust a classification point by adjusting the speed of the airflow and the centrifugal force. Specifically, as the classifying unit 30, cyclone, elbow jet, eddy classifier, and the like are used. Particularly, since the cyclone is simple in structure, it is possible to appropriately use it as the classifying unit 30.

The classifying unit 30 has, for example, an inlet 31, a cylindrical unit 32 to which the inlet 31 is connected, an inverse cone unit 33 that is positioned below the cylindrical unit 32 and is continuous with the cylindrical unit 32, a lower outlet 34 disposed in a lower center of the inverse cone unit 33, and an upper outlet 35 disposed in an upper center of the cylindrical unit 32.

In the classifying unit 30, the airflow carrying the defibrated material introduced from the inlet 31 is changed into a circumferential movement by the cylindrical unit 32. Thus, the centrifugal force is applied to the introduced defibrated material and the classifying unit 30 can separate the fiber (first classified material) of which the size is larger and the density is higher than the resin particles, the color material, and the additives in the defibrated material and the resin particles, the color material, the additives, and the like (second classified material) of which the size is smaller than the fiber in the defibrated material. The first classified material is discharged from the lower outlet 34 and is introduced into the sorting unit 40 through a pipe 4. On the other hand, the second classified material (material that is not used in manufacturing of the sheet in the raw materials) is discharged to a storage unit 36 through a pipe 5 from the upper outlet 35. The storage unit 36 introduces the second classified material separated by the classifying unit 30 from the inlet 37 and stores the second classified material. The storage unit 36 includes a storage amount detection unit (not illustrated) detecting an amount stored in the storage unit 36.

The sorting unit 40 introduces the first classified material passing through the classifying unit 30 from an inlet 42 and sorts the first classified material by lengths of the fibers. As the sorting unit 40, for example, a sieve (screen) is used. The sorting unit 40 has a net (filter and screen) and can separate the defibrated material into fibers or particles (those passing through the net, a first sorted material) smaller than a size of a mesh of the net containing the first classified material and the fibers, the non-defibrated pieces, or lumps (those that do not pass through the net, a second sorted material) larger than the size of the mesh of the net. For example, the first sorted material is transferred to the mixing unit 50 through a pipe 7 after being received in a hopper 6. The second sorted material is returned from an outlet 44 to the defibrating unit 20 through a pipe 8. Specifically, the sorting unit 40 is a cylindrical sieve that can be driven to be rotated by a motor. As the net of the sorting unit 40, for example, wire mesh, expanded metal that is formed by extending a metal plate in which cut lines are run, and a perforated metal in which holes are formed in a metal plate by a press machine are used.

The mixing unit 50 mixes the first sorted material passing through the sorting unit 40 and the additives (additive materials) containing resin. The mixing unit 50 configures a part of the forming unit. The mixing unit 50 has an additive supply unit 52 (adding unit), a pipe 54 that transports the sorted materials and the additives, and a blower 56. In the illustrated example, the additives are supplied from the additive supply unit 52 to the pipe 54 through a hopper 9. The pipe 54 is connected to the pipe 7.

In the mixing unit 50, the airflow is generated by the blower 56 and in the pipe 54, it is possible to transport the first sorted material and the additives while being mixed. Moreover, a mechanism for mixing the first sorted material and the additives is not specifically limited, may be one which stirs the first sorted material and the additives by rotating blades or may be one which uses rotation of a container as a V type mixer. Furthermore, the mixing unit 50 has a plurality of rotation units having rotating blades and may mix the first sorted material (fiber) and the additive (resin) by passing through the rotation units.

As the additive supply unit 52, a screw feeder as illustrated in FIG. 1, a disk feeder (not illustrated), and the like are used. The additives supplied from the additive supply unit 52 contain resin for binding a plurality of fibers. At the time resin is supplied, the plurality of fibers are not bound. Resin is melted when passing through the sheet formation unit 80 and binds the plurality of fibers. The additive supply unit 52 includes a remaining amount detection unit (not illustrated) detecting a remaining amount of the additive.

Moreover, the additives supplied from the additive supply unit 52 may contain coloring agents for coloring fibers, coagulation preventing agents for preventing coagulation of fibers, and flame retardants by which the fibers and the like are unlikely to be burned depending on a type of the manufacturing sheet in addition to resin binding fibers. A mixture (mixture of the first sorted material and the additives) passing through the mixing unit 50 is transmitted to the accumulation unit 60 through the pipe 54.

The accumulation unit 60 introduces the mixture passing through the mixing unit 50 from an inlet 62, loosens entangled defibrated material (fibers), and drops the defibrated material while dispersing the defibrated material in the air. The accumulation unit 60 configures a part of the forming unit. The accumulation unit 60 can be an ejection unit that ejects the mixture and drops the mixture to the web formation unit 70. Furthermore, the accumulation unit 60 loosens the entangled resins if resins of the additives supplied from the additive supply unit 52 are fibers. Thus, the accumulation unit 60 can deposit the mixture in the web formation unit 70 with high uniformity.

As the accumulation unit 60, a rotating cylindrical sieve is used. The accumulation unit 60 has a net and drops fibers or particles (passing through the net) contained in the mixture passing through the mixing unit 50, which are smaller than a size of a mesh of the net. A configuration of the accumulation unit 60 is, for example, the same as the configuration of the sorting unit 40.

Moreover, the "sieve" of the accumulation unit 60 may not have a function of sorting a particular object. That is, the "sieve" that is used for the accumulation unit 60 means a sieve having a net and the accumulation unit 60 may drop all mixtures introduced into the accumulation unit 60.

The web formation unit 70 forms a web W by accumulating a material passing through the accumulation unit 60. The web formation unit 70 configures a part of the forming unit and forms the web W by being air laid. The web formation unit 70 has, for example, a mesh belt 72, tension rollers 74, and a suction mechanism 76.

The mesh belt 72 accumulates the material passing through an opening (opening of the net) of the accumulation unit 60 while moving. The mesh belt 72 is stretched by the tension rollers 74 and has a configuration through which the passed material is unlikely to pass and air is likely to pass. The mesh belt 72 is moved by rotating the tension roller 74. The material passing through the accumulation unit 60 is continuously dropped and accumulated while the mesh belt 72 continuously moves and thereby the web W is formed on the mesh belt 72. The mesh belt 72 is made of, for example, metal, resin, fabric, nonwoven fabric, and the like. The mesh belt 72 receives the airflow containing the mixture dropped from the accumulation unit 60 and through which gas passes by collecting the mixture.

The suction mechanism 76 is provided on a lower side (side opposite to the accumulation unit 60 side) of the mesh belt 72. The suction mechanism 76 can generate airflow (airflow from the accumulation unit 60 to the mesh belt 72) to the lower side. The mixture dispersed in the air by the accumulation unit 60 can be sucked on the mesh belt 72 by the suction mechanism 76. That is, the suction mechanism 76 can be a suction unit that sucks the mixture ejected by the accumulation unit 60 through the mesh belt 72. Thus, it is possible to increase a discharge speed from the accumulation unit 60. Furthermore, it is possible to form down-flow in a fall path of the mixture by the suction mechanism 76 and it is possible to prevent falling defibrated material and the additives from being entangled.

As described above, the web W of a state of being soft and inflated containing a lot of air is formed by going through the accumulation unit 60 and the web formation unit 70 (web forming process). The web W accumulated in the mesh belt 72 is transported to the sheet formation unit 80.

Moreover, in the illustrated example, a moisture-adjusting unit 78 adjusting moisture of the web W is provided. The moisture-adjusting unit 78 can adjust an amount ratio of the web W and water by adding water or steam with respect to the web W.

The sheet formation unit 80 forms a sheet S by pressurizing and heating the web W accumulated in the mesh belt 72. The sheet formation unit 80 configures a part of the forming unit. In the sheet formation unit 80, it is possible to bind the plurality of fibers in the mixture through the additives (resin) to each other by adding heat to the mixture of the defibrated material and the additives mixed in the web W.

As the sheet formation unit 80, for example, a heating roller (heater roller), a heat press molding machine, a hot plate, a hot air blower, an infrared heater, and a flash fixing device are used. In the illustrated example, the sheet formation unit 80 includes a first binding unit 82 and a second binding unit 84, and the binding units 82 and 84 respectively include a pair of heating rollers 86. It is possible to form the sheet S while continuously transporting the web W by configuring the binding units 82 and 84 as the heating rollers 86 compared to a case where the binding units 82 and 84 are configured as a flat press device (flat plate press device). Moreover, the number of the heating rollers 86 is not specifically limited.

The cutting unit 90 cuts the sheet S formed by the sheet formation unit 80. In the illustrated example, the cutting unit 90 has a first cutting unit 92 that cuts the sheet S in a direction intersecting the transport direction of the sheet S and a second cutting unit 94 that cuts the sheet S in a direction parallel to the transport direction. For example, the second cutting unit 94 cuts the sheet S passing through the first cutting unit 92.

As described above, the cut sheet S of a predetermined size is formed. The cut sheet S that is cut is discharged to a discharge unit 96.

Figure 2:
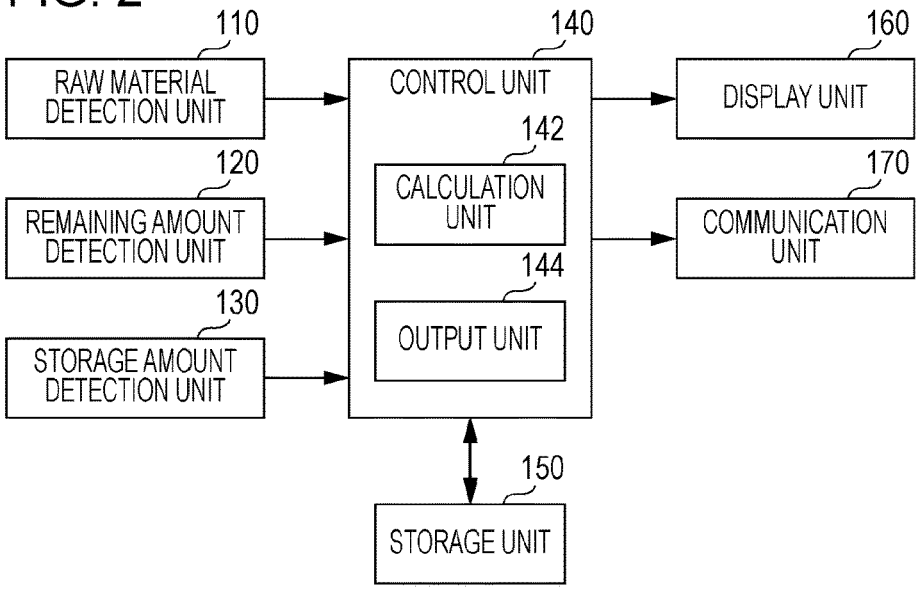
FIG. 2 is a functional block diagram view of the sheet manufacturing apparatus according to the embodiment.

FIG. 2 is a functional block diagram of the sheet manufacturing apparatus 100. The sheet manufacturing apparatus 100 includes a raw material detection unit 110, a remaining amount detection unit 120, a storage amount detection unit 130, the control unit 140, a storage unit 150, a display unit 160, and a communication unit 170. The sheet manufacturing apparatus 100 may have at least one of raw material detection unit 110, the remaining amount detection unit 120, and the storage amount detection unit 130, and may have at least one of the display unit 160 and the communication unit 170.

The raw material detection unit 110 detects the raw material amount (remaining amount) stacked on the supply unit 10 (stacking unit) and outputs a detection result to the control unit 140. The raw material detection unit 110 detects, for example, the number (or stacking height) of the cut sheets stacked on the supply unit 10 or a weight of the raw material stacked on the supply unit 10 as the "raw material amount". As the raw material detection unit 110, it is possible to use a contact type or optical type sensor, a weight sensor, and the like.

The remaining amount detection unit 120 detects the remaining amount of the additives (resin material, coloring agent, and the like) in the additive supply unit 52 (adding unit) and outputs the detection result to the control unit 140. As the remaining amount detection unit 120, it is possible to use an optical or electric sensor and the like.

The storage amount detection unit 130 detects an amount (storable amount) able to be stored in the storage unit 36 and outputs a detection result to the control unit 140. The storage amount detection unit 130 may directly detect the storable amount or detect the amount (storage amount) of a second classified portion (color material and the like) stored in the storage unit 36, obtains the detected storage amount and the storable amount from a volume (maximum storage amount) of the storage unit 36, and may output the obtained storable amount as the detection result. As the storage amount detection unit 130, it is possible to use a contact type or optical type sensor, a weight sensor, and the like.

The storage unit 150 stores programs for functioning of a computer as each unit of the control unit 140 and various data, and functions as a work region of the control unit 140. The function can be realized by a hard disk, a RAM, and the like. The display unit 160 is provided to output an image generated by the control unit 140 and can be realized by the display such as an LCD and a CRT. The communication unit 170 is provided to perform various controls for performing wired or wireless communication with another information processing device (a PC of a manager or a server of a supply source of consumable products) and the function can be realized by various processors, hardware such as a communication ASIC, programs, and the like.

The control unit 140 controls each unit of the sheet manufacturing apparatus 100 based on input information, a program, and the like. The function of the control unit 140 can be realized by various processors (CPU, DSP, and the like), hardware such as the ASIC and a program. The control unit 140 includes a calculation unit 142 and an output unit 144.

The calculation unit 142 calculates the amount of sheets (manufacturable number of sheets) able to be manufactured in the sheet manufacturing apparatus 100 based on the detection result from the raw material detection unit 110, the remaining amount detection unit 120, and the storage amount detection unit 130. More specifically, the calculation unit 142 calculates a first amount of the sheets able to be manufactured in the sheet manufacturing apparatus 100 based on the detection result (raw material amount) from the raw material detection unit 110, calculates a second amount of the sheets able to be manufactured in the sheet manufacturing apparatus 100 based on the detection result (additive remaining amount) from the remaining amount detection unit 120, and calculates a third amount of the sheets able to be manufactured in the sheet manufacturing apparatus 100 based on the detection result (storable amount) from the storage amount detection unit 130.

The output unit 144 performs a control for outputting (displaying the sheet amount on the display unit 160 and/or transmitting the sheet amount to another information processing device through the communication unit 170) the sheet amount (one of the first amount, the second amount, and the third amount) calculated by the calculation unit 142. More particularly, the output unit 144 outputs the smallest amount (smallest value) of the first amount, the second amount, and the third amount calculated by the calculation unit 142. Furthermore, if the sheet manufacturing apparatus 100 does not include the storage amount detection unit 130, the output unit 144 outputs the smaller one of the first amount and the second amount. Furthermore, if the sheet manufacturing apparatus 100 does not include the remaining amount detection unit 120 and the storage amount detection unit 130, the output unit 144 outputs the first amount. Similarly, if the sheet manufacturing apparatus 100 does not include the remaining amount detection unit 120, the output unit 144 outputs the smaller one of the first amount and the third amount, if the sheet manufacturing apparatus 100 does not include the raw material detection unit 110, the output unit 144 outputs the smaller one of the second amount and the third amount, if the sheet manufacturing apparatus 100 does not include the raw material detection unit 110 and the storage amount detection unit 130, the output unit 144 outputs the second amount, and if the sheet manufacturing apparatus 100 does not include the raw material detection unit 110 and the remaining amount detection unit 120, the output unit 144 outputs the third amount.

2. Process

Figure 3:
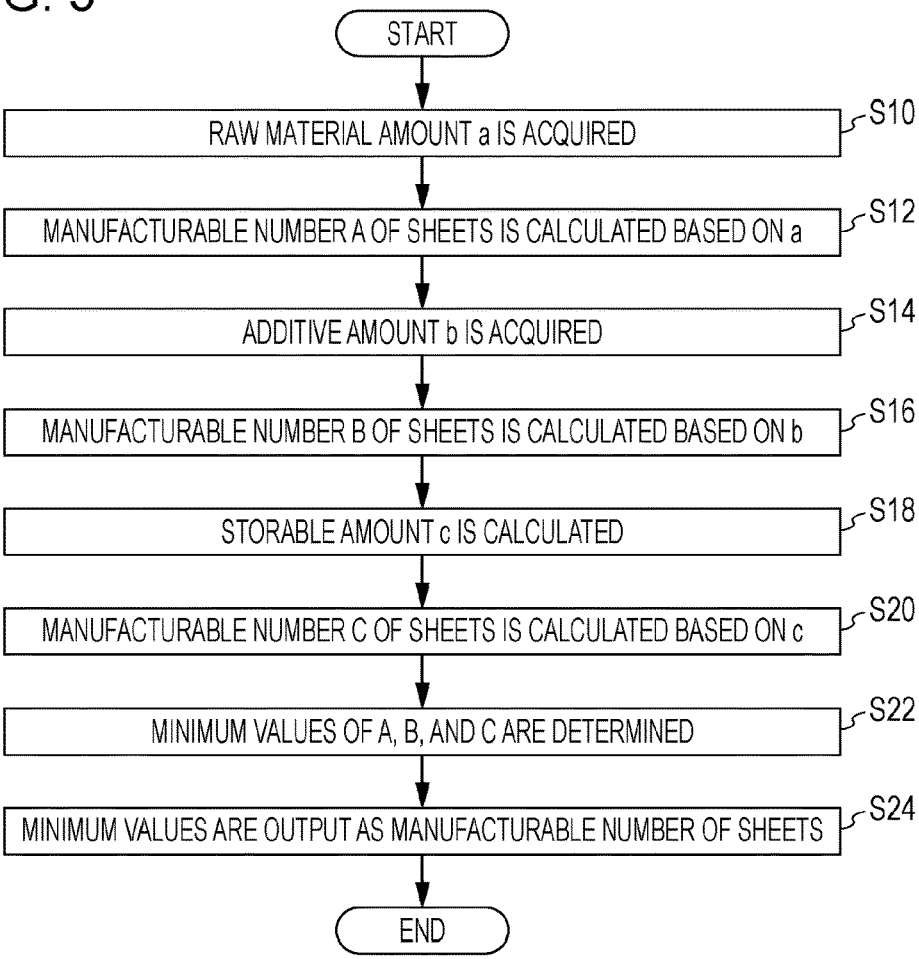
FIG. 3 is a flowchart illustrating an example of a process in the sheet manufacturing apparatus according to the embodiment.

Next, an example of a process in the sheet manufacturing apparatus 100 of the embodiment will be described with reference to a flowchart of FIG. 3.

First, the calculation unit 142 acquires a raw material remaining amount a detected by the raw material detection unit 110 (step S10) and the manufacturable number A of sheets (first amount) based on the raw material remaining amount a (step S12). Here, when a recovery ratio (rate of a second classified material (the color material and the like) amount with respect to a defibrated material amount introduced into the classifying unit 30) in the classifying unit 30 is Rc, the manufacturable number A of sheets can be obtained by the following Expression.

$$A=a\times(11-Rc)$$

For example, if the detected raw material remaining amount a is 100 sheets and the recovery ratio Rc is 0.1, it is calculated that A=100×0.9=90 (sheets). Here, a basis weight and size of one raw material (the cut sheet) are respectively assumed to be the same as a basis weight and size of one sheet that is manufactured. Furthermore, the recovery ratio Rc may be a fixed value or may be a variable value. For example, a ratio of the color material contained in the raw material is detected by an optical sensor and the like, and then the recovery ratio Rc may be estimated based on a detection result.

Next, the calculation unit 142 acquires an additive remaining amount b detected by the remaining amount detection unit 120 (step S14) and the manufacturable number B of sheets (second amount) is calculated based on the additive remaining amount b (step S16). Here, when an adding ratio (rate of a weight of the additive occupied in a weight per one sheet that is manufactured) of the additive is Ra and a weight per one sheet that is manufactured is Sp, the manufacturable number B of sheets can be obtained by the following Expression.

$$B=b/(Sp\times Ra)$$

For example, if the detected additive remaining amount b is 240 g, the adding ratio Ra is 0.1, and the weight Sp is 80 g per one sheet that is manufactured, it is calculated that B=240/8=30 (sheets). Here, the weight Sp may be a fixed value or may be a variable value. For example, if the basis weight and size of the manufacturing sheet are configured to be changed by a user, the weight Sp may be set based on the basis weight and size of the sheet set by the user.

Next, the calculation unit 142 acquires a storable amount c detected by the storage amount detection unit 130 (step S18) and the manufacturable number C of sheets (third amount) is calculated based on the storable amount c (step S20). Here, when a recovery ratio in the classifying unit 30 is Rc and the weight per one sheet of the raw material is Sm, the manufacturable number C of sheets can be obtained by the following Expression.

$$C=c/(Sm\times Rc)$$

For example, if the detected storable amount c is 320 g, the recovery ratio Rc is 0.1, and the weight Sm per one sheet of the raw material is 80 g, it is calculated that C=320/8=40 (sheets).

Next, the output unit 144 determines the minimum value by comparing A, B, and C captured in steps S12, S16, and S20 (step S22), and the minimum value is output as the manufacturable number of sheets (step S24). For example, if A=90, B=30, and C=40, "30 (sheets)" of the minimum value is output (displayed on the display unit 160 and transmitted to another information processing device through the network) as the manufacturable number of sheets.

3. Display Example

Figure 4:
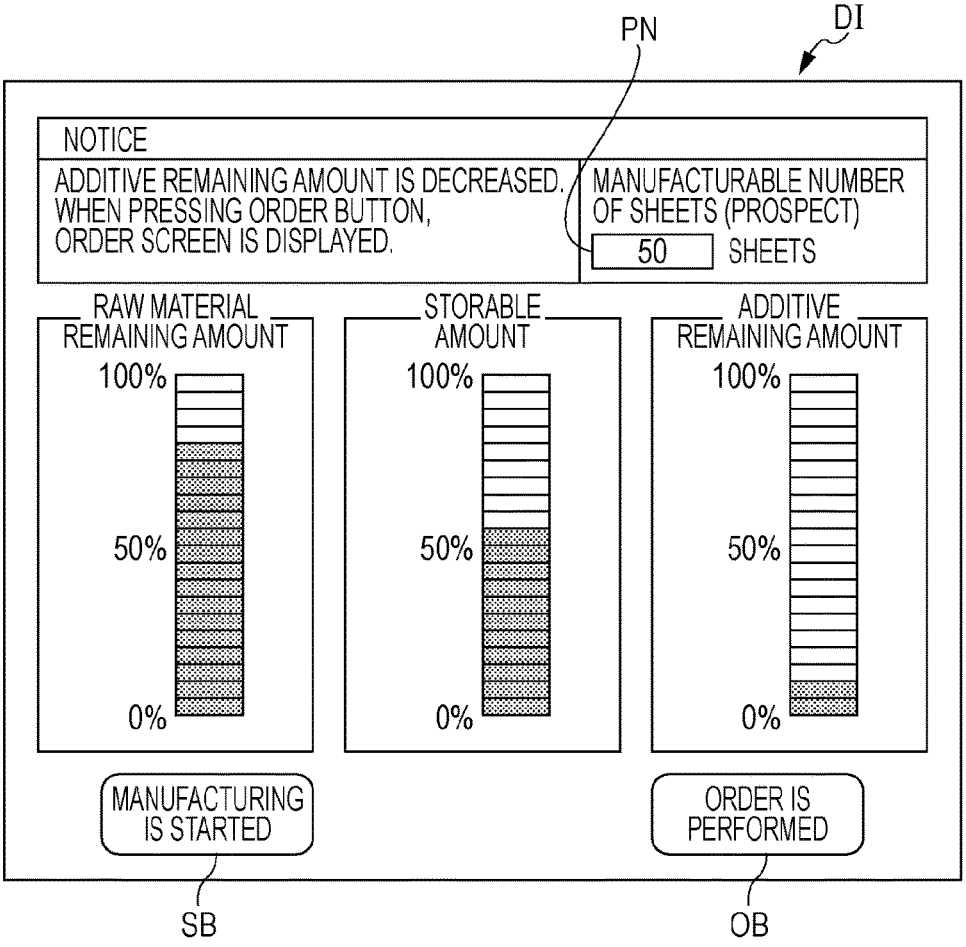
FIG. 4 is a view illustrating a first example of a display screen displayed in a display unit.

FIG. 4 is a view illustrating a first example of a display screen displayed on the display unit 160. The manufacturable number PN of sheets (minimum value of the first amount, the second amount, and the third amount) output from the output unit 144 is displayed on a display screen DI illustrated in FIG. 4. Furthermore, the raw material remaining amount detected by the raw material detection unit 110, the storable amount detected by the storage amount detection unit 130, and the additive remaining amount detected by the remaining amount detection unit 120 are displayed on the display screen DI. Furthermore, a manufacturing start button SB and an order button OB are displayed on the display screen DI, and if the user performs an operation to select the manufacturing start button SB, manufacturing of the sheet is started. Furthermore, if the user performs an operation to select the order button OB, information to order the additive is transmitted to a consumable product management server and an ordering process of the additive is automatically performed to a consumable product supply source. The user can grasp the remaining amounts and the recoverable amounts of the raw material and the additive, can grasp the manufacturable amount of sheets before starting manufacturing without replenishing the raw material and the additive during manufacturing and without removing the removal material stored in the storage unit, and convenience of the user can be improved by displaying the display screen DI on the display unit 160. Moreover, in the display screen DI, types (basis weight and the size) of the manufacturing sheet are configured to be set (change) and the manufacturable number PN of sheets may be changed in compliance with the set contents.

Figure 5:
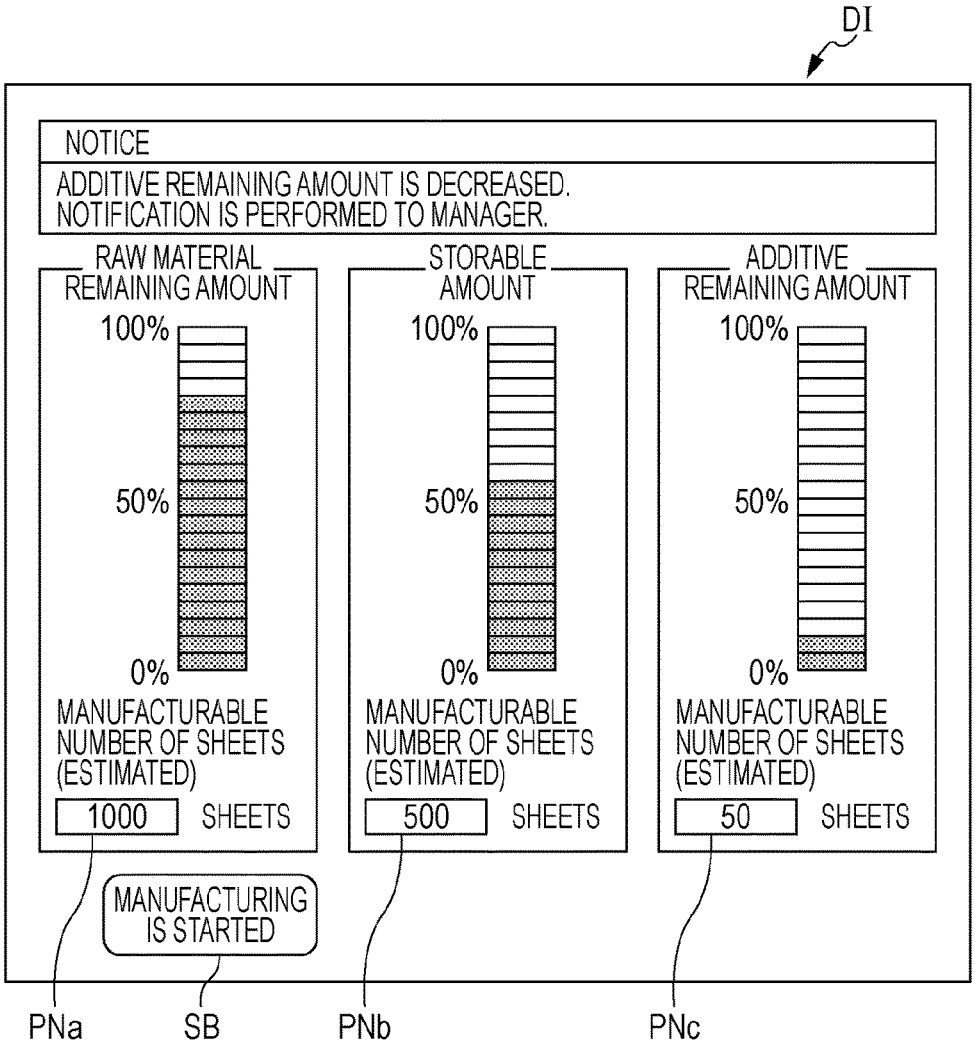
FIG. 5 is a view illustrating a second example of a display screen displayed in a display unit.

FIG. 5 is a view illustrating a second example of a display screen displayed on the display unit 160. In the example illustrated in FIG. 5, the manufacturable number PN of sheets output from the output unit 144 is not displayed on the display screen DI and the manufacturable number of sheets is transmitted (informed to the manager) to the PC of the manager. Furthermore, in the example illustrated in FIG. 5, since it is assumed that the manager performs the order of the consumable product (additive), the order button OB is not displayed. Furthermore, the manufacturable number PNa of sheets (first amount) obtained by being calculated from the raw material remaining amount detected by the raw material detection unit 110, the manufacturable number PNb of sheets (third amount) obtained by being calculated from the storable amount detected by the storage amount detection unit 130, and the manufacturable number PNc of sheets (second amount) obtained by being calculated from the additive remaining amount detected by the remaining amount detection unit 120 are displayed in the display screen DI illustrated in FIG. 5. The user can individually grasp each of the manufacturable number of sheets without replenishing the raw material, the manufacturable amount of sheets without removing the removal material from the storage unit, and the manufacturable amount of sheets without replenishing the additive by the displays.

Figure 6A:
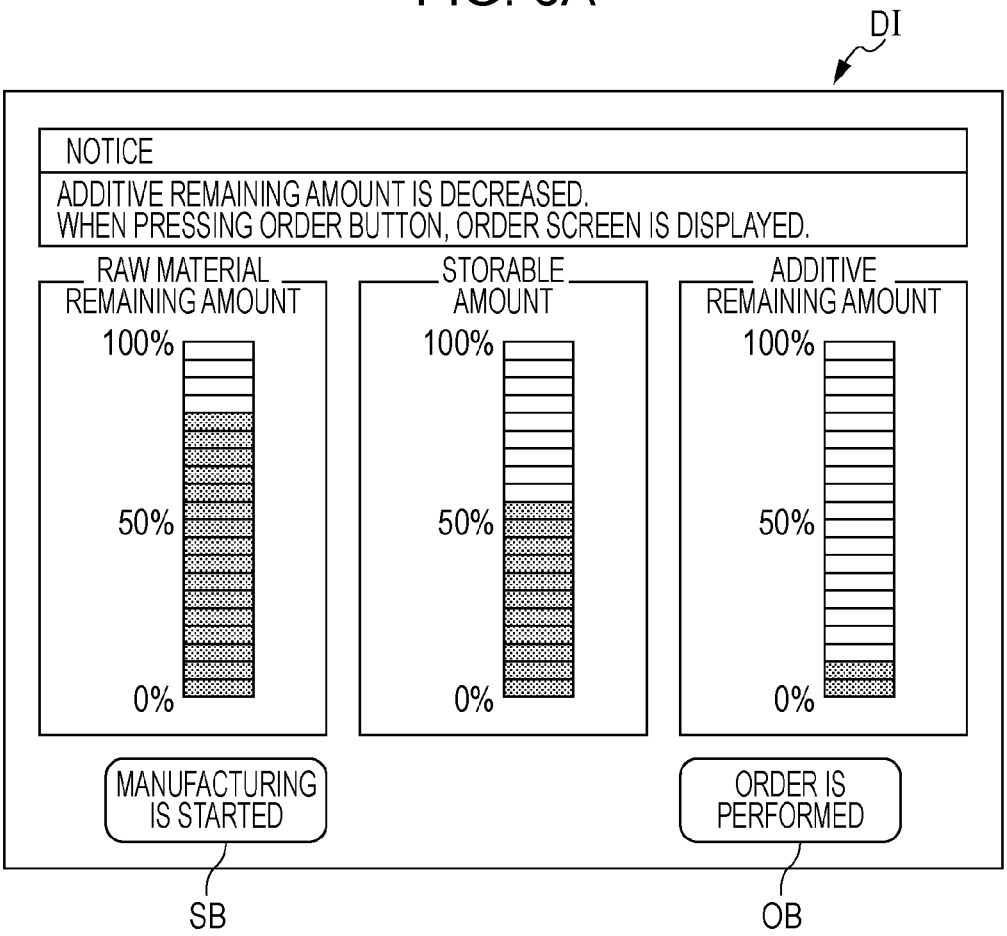
FIGS. 6A and 6B are views illustrating a third example of a display screen displayed in a display unit.
Figure 6B:
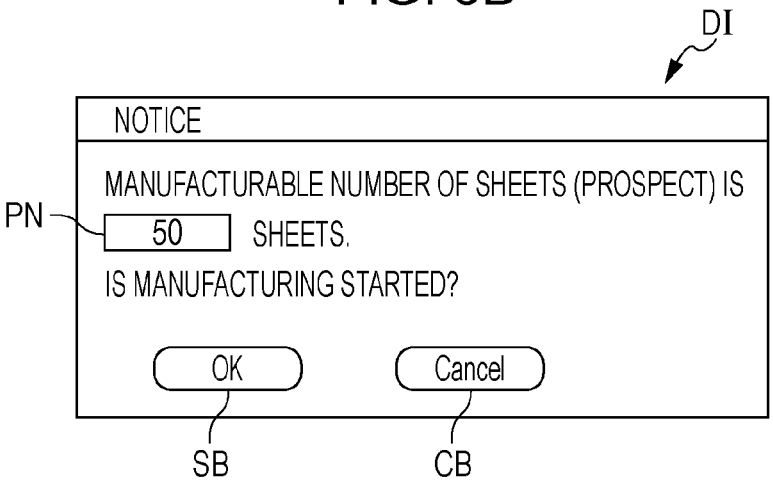

FIGS. 6A and 6B are views illustrating a third example of a display screen displayed on the display unit 160. In the display screen DI illustrated in FIG. 6A, the manufacturable number PN of sheets output from the output unit 144 is not displayed and if the user performs the operation to select the manufacturing start button SB, it is transited to the display screen DI illustrated in FIG. 6B and the manufacturable number PN of sheets is displayed on the display screen DI. Then, in the display screen DI illustrated in FIG. 6B, if the user performs an operation to select a confirmation button KB, manufacturing of the sheet is started and if the user performs an operation to select a cancel button CB, it is transited to the display screen DI illustrated in FIG. 6A.

4. Modification Example

The invention is not limited to the embodiments described above and various modifications can be performed. For example, the invention includes substantially the same configuration (for example, the same configuration in a function, a method, and a result or the same configuration in the object and the effect) as the configuration described in the embodiments. Furthermore, the invention includes a configuration that replaces non-essential parts of the configuration described in the embodiments. Furthermore, the invention includes a configuration which can perform the same operational effects or can achieve the same object as the configuration described in the embodiments. Furthermore, the invention includes a configuration obtained by adding a known technique to the configuration described in the embodiments.

Moreover, the sheet S that is manufactured by the sheet manufacturing apparatus 100 and the sheet manufacturing method according to the embodiments mainly refers to that having a sheet shape in which at least the fiber described above is the raw material. However, the sheet S is not limited to the sheet shape and may be a board shape, a web shape or a shape having unevenness. The sheet in the present specification is divided into paper and non-woven fabric. Paper includes aspects formed in the sheet shape in which pulp or the used paper is the raw material and includes recording paper for writing or printing, wallpaper, wrapping paper, colored paper, drawing paper, Kent paper, and the like. Non-woven fabric has a thickness thicker than that of paper or has a strength lower than that of paper, and includes general non-woven fabric, fiber board, tissue paper, kitchen paper, cleaner, filter, liquid absorption material, sound-absorbing material, cushioning material, mat, and the like.

In the embodiments described above, a case where the raw material of the cut sheet is stacked on the supply unit (stacking unit) is described, but it may be configured such that the raw material (shredded pieces) that is crushed by the shredder and the like is stacked on the supply unit (stacking unit). In this case, the raw material detection unit detects the weight or the stacked height of the raw material stacked on the supply unit (stacking unit). Furthermore, in this case, the crushing unit is not necessary.

Furthermore, in the embodiments described above, a case where the cut sheet is manufactured is described, but it may be configured such that a continuous sheet is manufactured. In this case, the calculation unit calculates a length of the continuous sheet as the manufacturable amount of sheets.

Furthermore, in the embodiments described above, a case of being applied to the dry type sheet manufacturing apparatus is described, but the invention may be applied to a wet type sheet manufacturing apparatus. In this case, the remaining amount detection unit detects remaining amounts of surfactant, bleach, macerating accelerator, and the like for removing the color material such as ink as the remaining amount of the additive.

The entire disclosure of Japanese Patent Application No. 2015-015221, filed Jan. 29, 2015 is expressly incorporated by reference herein.

What is claimed is:

1. A sheet manufacturing apparatus for manufacturing a sheet by using a raw material containing fibers supplied from a stacking unit on which the raw material is stacked, the apparatus comprising:

a raw material detection unit configured to detect a raw material amount stacked on the stacking unit;

a calculation unit configured to calculate a first amount of the sheet able to be manufactured in the sheet manufacturing apparatus based on a detection result of the raw material detection unit; and an output unit configured to output the sheet amount calculated by the calculation unit.

2. A sheet manufacturing apparatus for manufacturing a sheet by using a raw material containing fibers supplied by a supply unit supplying the raw material, the apparatus comprising:

an adding unit configured to add additives to the raw material supplied by the supply unit;

a remaining amount detection unit configured to detect an additive remaining amount;

a calculation unit configured to calculate the sheet amount able to be manufactured in the sheet manufacturing apparatus based on a detection result of the remaining amount detection unit; and an output unit configured to output the sheet amount calculated by the calculation unit.

3. A sheet manufacturing apparatus for manufacturing a sheet by using a raw material containing fibers supplied by a supply unit supplying the raw material, the apparatus comprising:

a storage unit configured to store at least a part of the raw material supplied by the supply unit which is not used in manufacturing of the sheet;

a storage amount detection unit configured to detect an amount able to be stored in the storage unit;

a calculation unit configured to calculate the sheet amount able to be manufactured in the sheet manufacturing apparatus based on a detection result of the storage amount detection unit; and an output unit configured to output the sheet amount calculated by the calculation unit.

4. The sheet manufacturing apparatus according to claim 1, further comprising:

an adding unit configured to add the additives to the raw material supplied from the stacking unit; and a remaining amount detection unit configured to detect an additive remaining amount, wherein the calculation unit is configured to calculate a second amount of the sheet able to be manufactured in the sheet manufacturing apparatus based on a detection result of the remaining amount detection unit, and wherein the output unit is configured to output a smaller one of the first amount and the second amount.

5. The sheet manufacturing apparatus according to claim 4, further comprising:

a storage unit configured to store at least a part of the raw material supplied from the stacking unit which is not used in manufacturing of the sheet; and a storage amount detection unit configured to detect an amount able to be stored in the storage unit, wherein the calculation unit is configured to calculate a third amount of the sheet able to be manufactured in the sheet manufacturing apparatus based on a detection result of the storage amount detection unit, and wherein the output unit is configured to output the smallest one of the first amount, the second amount, and the third amount.

* * * * *